US006125543A

United States Patent [19]

Jhones

[11] Patent Number: 6,125,543

[45] Date of Patent: Oct. 3, 2000

[54] DUAL BLADED KNIFE WITH ADJACENT DUAL LOCKING MECHANISMS

[75] Inventor: Peter H. Jhones, Golden, Colo.

[73] Assignee: Spyderco, Inc., Golden, Colo.

[21] Appl. No.: 09/324,278

[22] Filed: Jun. 2, 1999

[51] Int. Cl.[7] ..... B26B 1/04

[52] U.S. Cl. ..... 30/161; 30/155

[58] Field of Search ..... 30/155, 156, 157, 30/160, 161; D8/99

[56] References Cited

U.S. PATENT DOCUMENTS

| | | | |
|---|---|---|---|
| D. 391,465 | 3/1998 | Glesser | D8/99 |
| 825,093 | 7/1906 | Watson | 30/161 |
| 988,068 | 3/1911 | Beardsley et al. | 30/161 |
| 1,743,022 | 1/1930 | Carman | 30/161 |
| 2,718,695 | 9/1955 | Elsener | 30/161 |
| 2,930,121 | 3/1960 | Inman | 30/160 |
| 4,302,877 | 12/1981 | Hart et al. | 30/161 |
| 4,347,665 | 9/1982 | Glesser | 30/161 |
| 4,805,303 | 2/1989 | Gibbs | 30/161 |
| 5,044,079 | 9/1991 | Gibbs | 30/160 |
| 5,095,624 | 3/1992 | Ennis | 30/161 |

*Primary Examiner*—Hwei-Siu Payer
*Attorney, Agent, or Firm*—Sheridan Ross P.C.

[57] ABSTRACT

A dual bladed folding knife is provided which has adjacent locking mechanisms positioned proximate to an upper edge of the knife handle and dual finger depressions adapted for engagement by a user's finger for releasing the knife blades from a first extended position of use and a second closed position.

19 Claims, 4 Drawing Sheets

DUAL BLADED KNIFE WITH ADJACENT DUAL LOCKING MECHANISMS

FIELD OF THE INVENTION

This invention relates to folding knives, and more specifically hand held folding knives which have dual closing blades and associated locking mechanisms.

BACKGROUND OF THE INVENTION

Hand held knives have been used for centuries by hunters, craftsman and others requiring a sharpened blade for various purposes. Most early knives were non folding fixed blade knives, which are potentially dangerous due to the exposed blade which must be sheathed when not in use. These knives are additionally quite cumbersome when attached to a belt due to their significant length.

Hand held folding knives are characterized by the knife blade pivoting about the knife handle from a first extended position of use to a second closed position wherein the cutting portion of the knife blade is stored within a knife cavity positioned within the knife handle. These knives are generally much less cumbersome than fixed blade knives and are much safer to carry and store since the sharpened cutting edge is not exposed.

More recently, hand held folding knives have been made with a multiplicity of blades and accessory tools stored within the knife handle cavity. An example of this type of knife is the well-known "swiss army knife." These types of knives and multi-tools have become increasingly popular since a variety of different types of knife blades and accessory tools can be stored within one common handle. Unfortunately, the knife blade and other accessory tools utilized on these types of knives are very difficult to open and often do not have any type of locking mechanism. Those knives which do have locking mechanisms are often difficult to extend from a closed position to a position of use and can be potentially dangerous if the blade is not securely "locked" in a position of use, thus preventing inadvertent claims on a user's hand.

One recent example of a folding knife with dual blades and having interrelated locking mechanisms is disclosed in U.S. Pat. No. D391,465 to Glesser. This design encompasses a "back lock" locking mechanism for each blade which must be depressed by a user's finger to release the blade from an extended position of use. The back locks are positioned proximate to an upper edge of the knife handle. Unfortunately, the back lock release mechanisms are immediately adjacent one another, thus making it difficult to release one blade at a time with a user's finger. Furthermore, the positioning of the release mechanisms is problematic since for both blades the release mechanisms are positioned too close to the respective folding blade, thus providing very little leverage to release the locking mechanism. Finally, this type of dual locking mechanism provides insufficient rigidly for the knife handle during use of the knife blades and thus requires a shim plate on other similar device to reinforce the handle.

Thus, there is a need for a type of locking mechanism used in conjunction with multi-bladed folding knives which can be quickly and effectively located and activated by a user's finger. Further, the release mechanism must be positioned in a location which provides significant leverage and thus allows the efficient release of the blade from a locked extended position to a released position for storing the blade in the knife handle cavity.

SUMMARY OF THE INVENTION

It is thus an object of the present invention to provide an independent locking mechanism for a plurality of folding knife blades or tools which are rotatably interconnected to a common knife handle. It is a further object of the present invention that the locking mechanisms associated with the knife blades are positioned proximate to an upper edge of the knife handle for access by a user's thumb and that the locking mechanism can be easily depressed to release the knife blades from a first extended position of use to a second closed position.

Thus, in one aspect of the present invention, a dual bladed folding knife with associated locking mechanisms is provided which comprises:

a handle having a first end, a second end and a cavity extending therebetween;

a first blade rotatably interconnected to said first end of said handle, said first blade comprising a cutting edge, a pointed end and a heel end having a blade engagement slot;

a second blade rotatably interconnected to said second end of said handle, said second blade comprising a cutting edge, a pointed end and a heel end having a blade engagement slot, wherein each of said first blade and said second blades travel between a first extended position of use and a second closed position with said cutting edge positioned substantially within said cavity of said handle;

a locking mechanism for said first blade and said second blade, each of said locking mechanisms comprising:

(a) a rigid locking bar having a first end and a second end, said locking bar pivotally interconnected to said handle;

(b) a tang interconnected to said first end of said locking bar for operably engaging said engagement slot positioned in said heel end of said blade when said blade is in said first extended position of use;

(c) a biasing means interconnected to said handle on a first end and in operable engagement with a lower edge of said rigid locking bar on a second end to provide an upward force on said second end of said locking bar;

(d) a first finger depression and a second finger depression positioned on an upper edge of said substantially rigid locking bar and shaped for engagement by a user's thumb, said second finger depression positioned at least about a midway point of said length of said knife handle, wherein when a downward force is applied to said second finger depression said substantially rigid locking bar tang is released from said blade engagement slot, allowing said blade to rotate to said second closed position.

DETAILED DESCRIPTION

Figure 1:
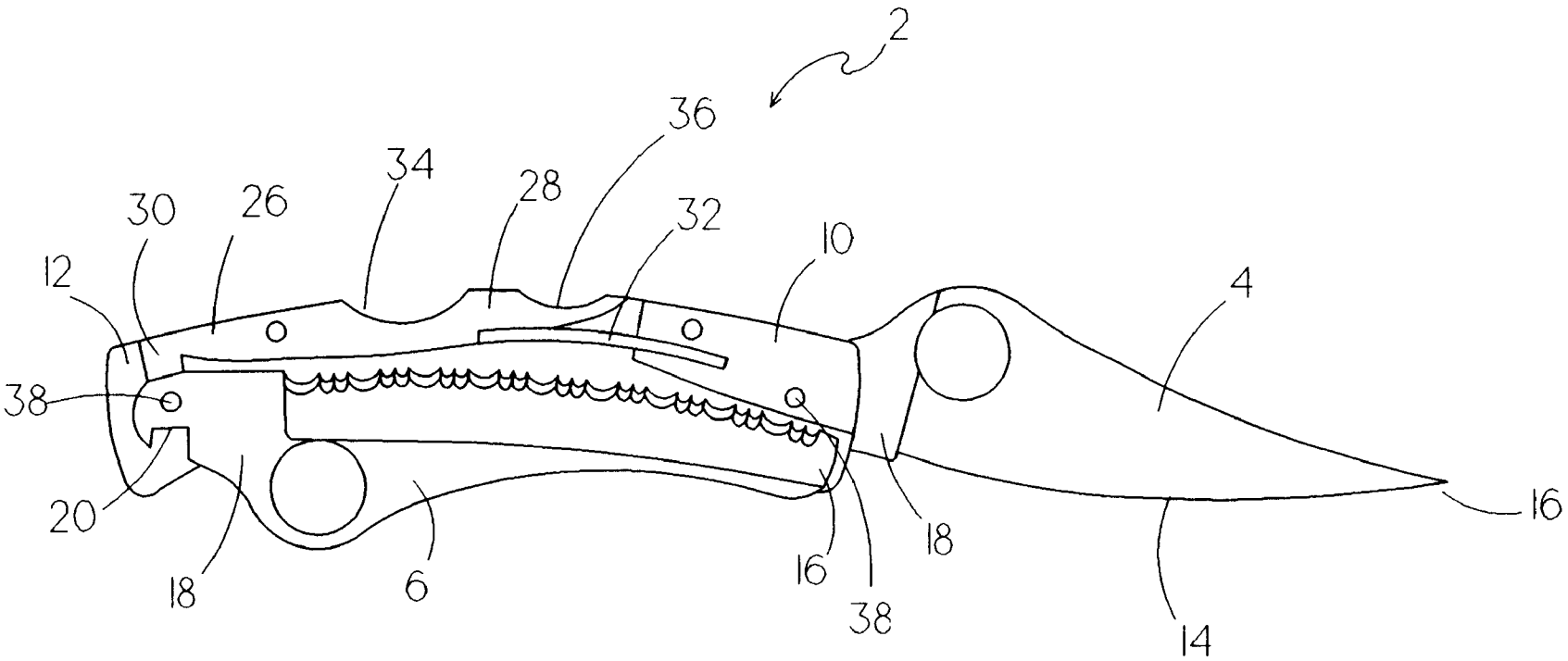
FIG. 1 is a front elevation view of the present invention with the front scale of the handle removed for clarity and showing a first blade in an extended position of use and a second knife in a closed position.
Figure 2:
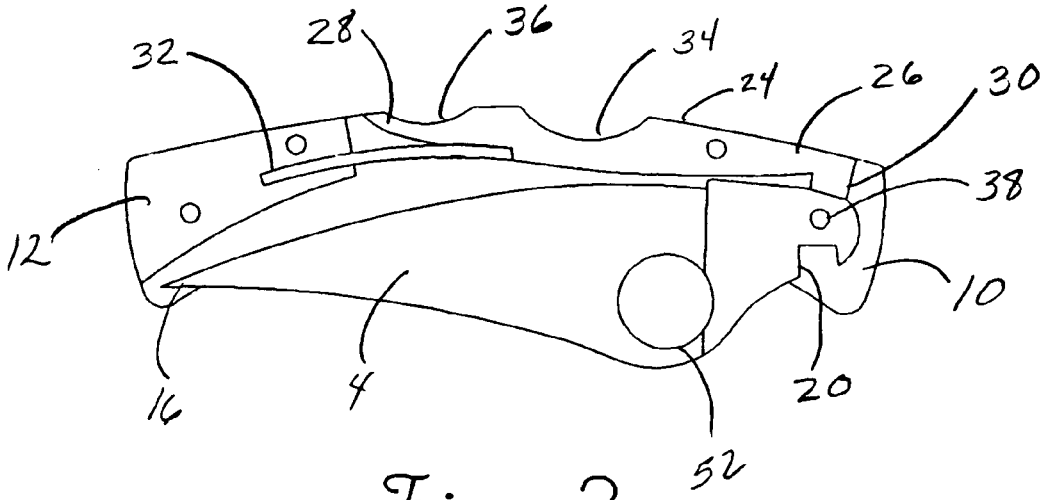
FIG. 2 is a front elevation view of the present invention with the front scale of the handle and the second blade removed for clarity, and showing the first blade in a closed position.

Referring now to the drawings, FIG. 1 is a front elevation view of the dual bladed folding knife 2 showing a first blade 4 and a second blade 6 interconnected to a handle 8. The handle 8 is generally comprised of a first scale and second scale which define a cavity therebetween for receiving the first blade 4 and second blade 6 in a closed position with the cutting edge of the knife blade retained within the knife cavity. In FIG. 2, the front scale is removed for clarity purposes to further identify the second blade 6 in a closed position within the knife cavity. As seen in this drawing, the first blade 4 and second blade 6 each comprise a blade pointed end 16, a blade cutting edge 14 and a blade heel end 18. The blade heel end 18 is interconnected to the handle 8 by means of a blade rotation pin 38 which allows each of the blades to rotate between a first extended position of use and a second closed position wherein the blade cutting edge 14 is positioned within the knife handle cavity. Positioned proximate to the blade heel end 18 is an engagement slot 20 which receives a tang 30 when the knife 2 is in a first extended position. This locking mechanism allows the blade to be secured in a fixed extended position and prevents the inadvertent closing of the blade without release from the locking mechanism 22.

The locking mechanisms used for both the first blade 4 and the second blade 6 generally comprises a locking bar 24 which is comprised of a locking bar first end 26, a locking bar second end 28, and the tang 30. Further, the locking bar 24 comprises a first finger depression 34 and a second finger depression 36, the second finger depression being sized for receiving a user's finger or thumb for depression purposes to release the tang 30 from the blade engagement slot 20. As shown in FIG. 1, the first finger depression 34 for both the first blade and the second blade is positioned closest to the respective blade heel end. The first finger depression 34 is utilized solely for allowing access to the second finger depression and is not utilized for releasing the locking mechanism from the blade.

A biasing pin 32 is provided which is interconnected on a first end to the knife handle and is positioned in contact with a lower end of the locking bar second end 28 to bias the locking bar second end 28 in an upward position. Thus, to release the locking bar tang 30 from the engagement slot 20, a downward force is provided on the second finger depression 36 to force the biasing pin 32 downward and release the tang 30 from the engagement slot 20. Although not visible in FIG. 1, an identical locking mechanism is used in conjunction with the first blade 4 to allow the opening and closing of this particular blade.

Referring now to FIG. 2, a cutaway view of the dual bladed folding knife 2 is shown with the first blade 4 in a closed position and with the second blade 6 removed for clarity purposes. As seen in this drawing, when the first blade 4 is in a closed position, the tang 30 is disengaged from the engagement slot 20, thus allowing the free rotation of the blade from the first extended position of use to the second closed position shown. The blade is rotatably interconnected to the handle first end 10 by means of a blade rotation pin 38. Furthermore, the locking bar first end 26 and locking bar second end 28 can clearly be seen with both the first finger depression 34 and second finger depression 36 positioned therebetween on an upper edge of the locking bar 24. The locking bar second end 28 is biased in an upward position by the biasing pin 32 which is interconnected to the handle on a first end and positioned against a lower edge of the locking bar 24 on a second end. Although the use of a locking pin 32 is a preferred embodiment of the present invention to provide a basing force to the locking bar, it should be appreciated by one skilled in the art that any type of biasing means such as a spring or latch assembly could be used in replacement of the biasing pin 32.

As further identified in FIG. 2, the blade comprises a blade opening aperture 52 which allows the blade to be opened from a closed position to a first extended position of use by the user providing thumb or finger pressure on the blade opening aperture 52 in a downward direction. When this force is applied, the blade rotates about the handle first end 10 without requiring the use of a second hand. Alternatively, a thumb stud which projects in a substantially perpendicular direction from the plane of the first blade may be used to permit one handed opening of the knife blade.

Figure 3:
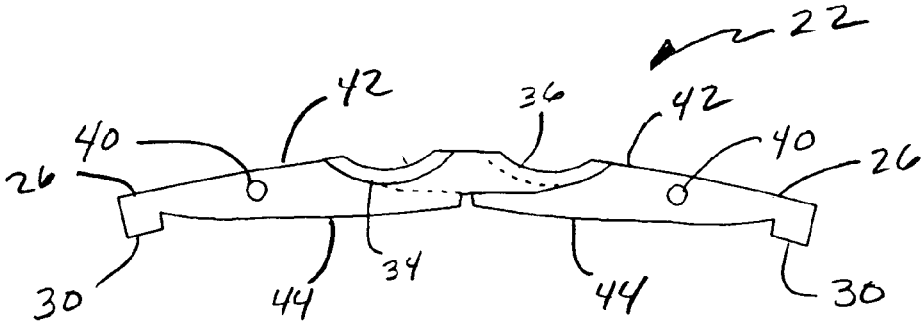
FIG. 3 is a front elevation view of the locking mechanism including a first locking mechanism and a second locking mechanism.

Referring now to FIG. 3, a depiction of the locking mechanism 22 used in conjunction with the first blade 4 and the second blade 6 is provided herein. The locking mechanism 22 generally comprises two identical locking bars 24 each comprising a locking bar first end 26 and a locking bar second end 28. The locking bar first end 26 comprises a tang 30 which engages the blade engagement slot 20 to prevent the inadvertent closing of the blade. Additionally, the blade of the locking bar 24 is pivotally interconnected to the handle by means of a locking bar pin 40.

Furthermore, the locking bar consists of a locking bar upper edge 42 and locking bar lower edge 44, the upper edge having a first finger depression 34 and a second finger depression 36 positioned between the locking bar first end 26 and the locking bar second end 28. The significance of the first finger depression 34 and second finger depression 36 becomes quite apparent upon review of the drawings and is necessary to allow the opening of the first blade 4 and the second blade 6 in an efficient and simplistic manner. More specifically, the first finger depression 34 for each of the respective blades is positioned proximate to the blade heel end 18. Thus, the first finger depression 34 on the first blade 4 is positioned adjacent the second finger depression 36 on the second blade 6. The adjacent finger depression allows the user of the knife to locate and depress the respective second finger depression 36 for each particular blade, without having to depress the first blade depression and respective locking mechanism 22 for the blade not in use. Thus, the second finger depression 36 of the first blade is elevated above the first finger depression 34 of the second blade, and the second finger depression 36 of the second blade is elevated above the first finger depression 34 of the first blade. This configuration allows a significant amount of leverage to be provided on the second finger depression 36 for each respective blade to permit the disengagement of the tang 30 from the engagement slot 20 and to permit the blade 4 to rotate between a first extended position of use and a second closed position.

Figure 4:
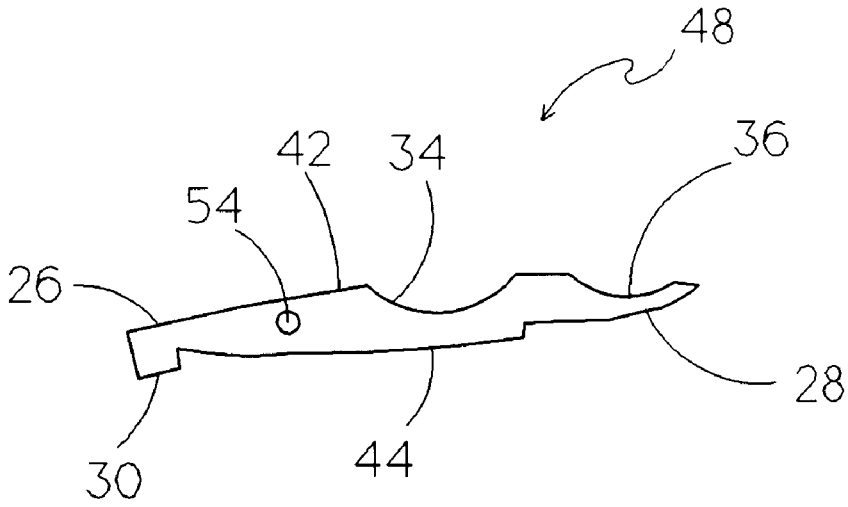
FIG. 4 is a front elevation view of a second locking mechanism associated in use with a second blade.

Referring now to FIG. 4, the locking mechanism 22 used in conjunction with the second blade 6 shown in FIG. 1 is provided herein. Thus, the second locking mechanism 48 is used in conjunction with the second blade 6, while FIG. 5 identifies a first locking mechanism 46 used in conjunction with the first blade 4. As shown, the second locking mechanism comprises a locking bar 24 consisting of a locking bar first end 26 and a locking bar second end 28. The locking bar 24 further comprises a locking bar upper edge 42, a locking bar lower edge 44, and a locking bar aperture 54 operably sized to receive a locking bar pin 40 which is interconnected to the knife handle 8.

As further seen in FIG. 4, the locking bar 24 has a first finger depression 34 positioned forward of a second finger depression 36. The second finger depression 36 is used to rotatably disengage the tang 30 from the blade engagement slot 20, while the first finger depression 34 is used solely for allowing the user to engage the second finger depression 36 of the first locking mechanism 46. Thus the first finger depression 34 and second finger depression 36 of each respective locking bars 24 permits the user of the dual bladed folding knife to access the locking mechanism with their respective thumb or finger in a quick and efficient manner.

Figure 5:
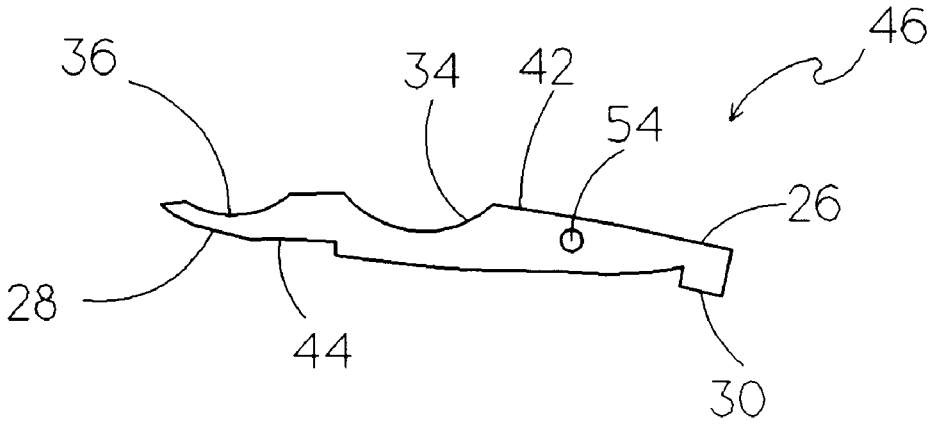
FIG. 5 is a front elevation view of a first locking mechanism associated in use with a first blade.
Figure 6:
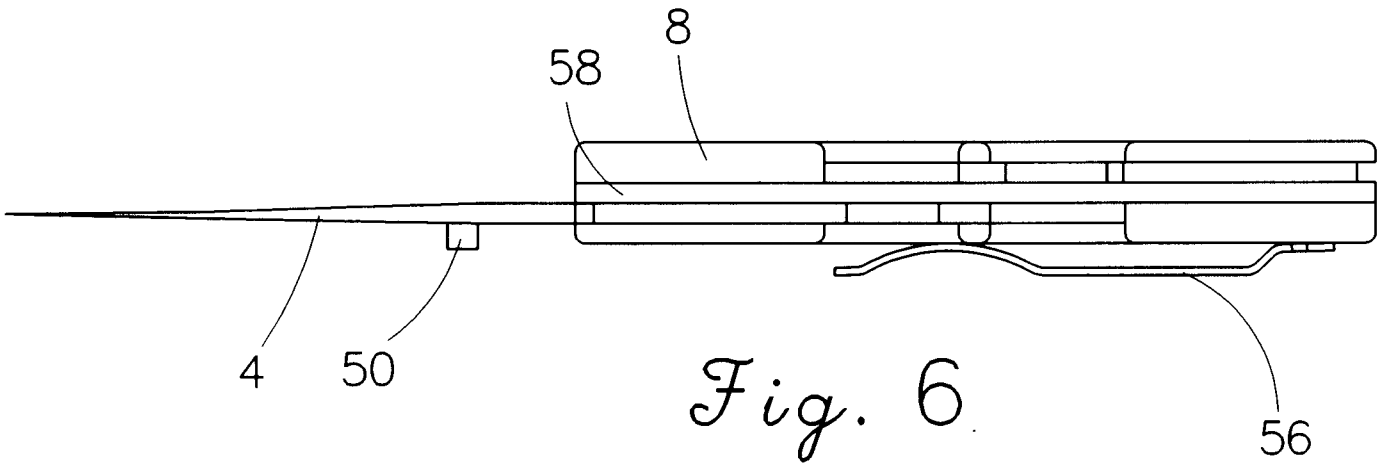
FIG. 6 is a top plan view of the invention of FIG. 1 shown with opposing handle scales and a clip.
Figure 7:
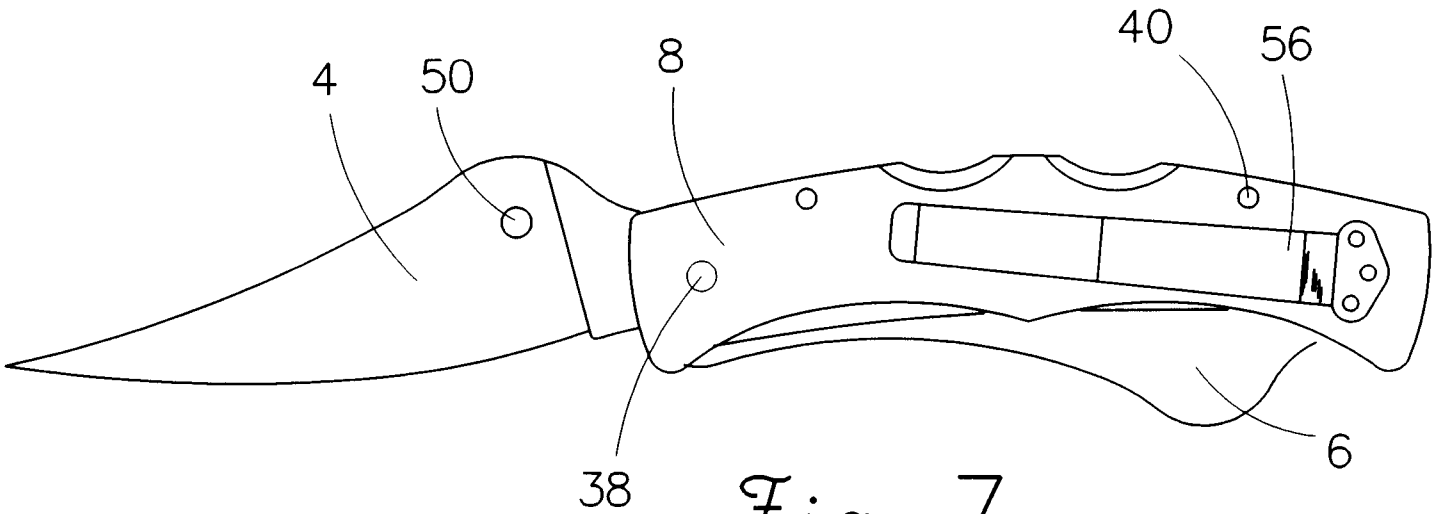
FIG. 7 is a front elevation view of the knife shown in FIG. 6.

Referring now to FIG. 5, a first locking mechanism is provided which is substantially a mirror image of the second locking mechanism 48 shown in FIG. 4. Thus, the second finger depression 36 used with the first locking mechanism 46 allows the release of the tang 30 from the engagement slot 20 of the first blade 4. The first finger depression 34 positioned in the locking bar 24 is used solely for allowing the second finger depression of the second locking mechanism 48 to be depressed. Thus, the adjacent dual configuration of the locking mechanisms 22 allow the efficient operation of both the first blade 4 and the second blade 6 in a compact, yet novel dual knife configuration.

For clarity purposes the following list of components and respective numbering used in the drawings is provided herein:

| No. | Component |
|---|---|
| 02 | Dual bladed folding knife |
| 04 | First blade |
| 06 | Second blade |
| 08 | Handle |
| 10 | Handle first end |
| 12 | Handle second end |
| 14 | Blade cutting edge |
| 16 | Blade pointed end |
| 18 | Blade heel end |
| 20 | Engagement slot |
| 22 | Locking mechanism |
| 24 | Locking bar |
| 26 | Locking bar first end |
| 28 | Locking bar second end |
| 30 | Tang |
| 32 | Biasing pin |
| 34 | First finger depression |
| 36 | Second finger depression |
| 38 | Blade rotation pin |
| 40 | Locking bar pin |
| 42 | Locking bar upper edge |
| 44 | Locking bar lower edge |
| 46 | First locking mechanism |
| 48 | Second locking mechanism |
| 50 | Thumb stud |
| 52 | blade opening aperture |
| 54 | Locking bar aperture |
| 56 | Clip |
| 58 | Rigid shim plate |

It is understood that the above description is of a preferred exemplary embodiment of the invention, and that the invention is not limited to the specific forms described herein. Such other configurations and constructions are considered to be within the scope of the invention. Thus, these and other substitutions, modifications, changes and omissions may be made in the design and arrangement of the elements and the manufacturing steps without departing from the scope of the claims.

What is claimed is:

1. A folding knife with dual folding blades, comprising:

a handle having a first end, a second end and a cavity extending therebetween;

a first blade rotatably interconnected to said first end of said handle, said first blade comprising a cutting edge, a pointed end and a heel end having an engagement slot;

a second blade rotatably interconnected to said second end of said handle, said second blade comprising a cutting edge, a pointed end and a heel end having an engagement slot, wherein each of said first blade and said second blade travel between a first extended position of use and a second closed position with said cutting edge positioned substantially within said cavity of said handle;

a locking mechanism for each of said first blade and said second blade, each of said locking mechanisms comprising:

(a) a rigid locking bar having a first end and a second end, said locking bar pivotally interconnected to said handle;

(b) a tang interconnected to said first end of said locking bar for operably engaging said engagement slot positioned in said heel end of said blade when said blade is in said first extended position of use;

(c) a biasing means interconnected to said handle on a first end and in operable engagement with a lower edge of said rigid locking bar on a second end to provide an upward force on said second end of said locking bar;

(d) a first finger depression and a second finger depression positioned on an upper edge of said rigid locking bar and shaped for engagement by a user's thumb, said second finger depression positioned at least about a midway point of the length of said knife handle opposite said heel end of said blade, wherein when a downward force is applied to said second finger depression said tang is released from said blade engagement slot, allowing said blade to rotate to said second closed position.

2. The folding knife of claim 1, wherein said first finger depression for said first blade is positioned immediately adjacent said second finger depression for said second blade.

3. The folding knife of claim 1, wherein said second finger depression of said first blade is elevated above said first finger depression of said second blade and said second finger depression of said second blade is elevated above said first finger depression of said first blade.

4. The folding knife of claim 1, wherein said first and said second finger depressions have an arcuate shape.

5. The folding knife of claim 1, wherein said biasing means comprises a rigid metallic bar having a longitudinal length substantially parallel to said handle.

6. The folding knife of claim 1, further comprising a rigid shim plate positioned between said locking mechanisms for said first blade and said second blade.

7. The folding knife of claim 1, wherein said first blade and said second blade are pivotally interconnected to said handle by a pivot pin extending through a blade pivot aperture and a handle aperture.

8. The folding knife of claim 1, further comprising a clip interconnected to said knife handle which is adapted for interconnection to an article of clothing.

9. The folding knife of claim 1, wherein said first blade and said second blade have a blade aperture positioned proximate to said heel end of said blade and which is adapted for receiving a user's thumb when said knife blade is in said second closed position of use, wherein said knife blade can be opened to a first extended position of use with one hand.

10. The folding knife of claim 1, wherein said first blade and said second blade have a thumb stud positioned proximate to said heel end of said blade which is adapted for receiving a user's thumb when said knife blade is in said second closed position of use, wherein said knife blade can be opened to a first extended position of use with one hand.

11. A folding knife having adjacent dual blades and associated locking mechanisms, comprising:

a handle having a first end, a second end and a cavity extending substantially therebetween;

a first blade rotatably interconnected to said first end of said handle, said first blade having a pointed end, a heel end, a cutting edge extending substantially therebetween and an engagement slot positioned proximate to said heel end;

a second blade rotatably interconnected to said second end of said handle, said second blade having a pointed end, a heel end, a cutting edge extending substantially therebetween and an engagement slot positioned proximate to said heel end;

a first locking mechanism for said first blade and a second locking mechanism for said second blade, said locking mechanisms positioned substantially adjacent one another within said knife handle, each of said first locking mechanism and said second locking mechanism comprising:

(a) a rigid locking bar having a first end, a second end, an upper edge and a lower edge, said upper edge having a first finger depression and a second finger depression operably sized for receiving a user's thumb, said second finger depression of said first locking mechanism having a greater elevation than said first finger depression of said second locking mechanism and said second finger depression of said second locking mechanism having a greater elevation than said first finger depression of said first locking mechanism;

(b) a biasing means operably interconnected to said handle on a first end and in contact with a lower edge of said rigid locking bar to provide an upward force on said second end of said rigid locking bar proximate said second finger depression, wherein when a downward force is applied to said second finger depression a tang interconnected to said locking bar is released from said engagement slot in said blade when said blade is in a first extended position, wherein said knife blade is released to travel from said first extended position of use to a second closed position.

12. The folding knife of claim 11, wherein said biasing means comprises a rigid metallic bar having a longitudinal length which is oriented substantially parallel to a longitudinal axis of said knife handle.

13. The folding knife of claim 11, wherein said first and said second finger depressions have a substantially arcuate shape.

14. The folding knife of claim 11, wherein said first finger depression of said first locking bar is immediately adjacent said second finger depression of said second locking bar and said first finger depression of said second locking bar is immediately adjacent said second finger depression of said first locking bar.

15. The folding knife of claim 11, further comprising a clip interconnected to said handle which is adapted for interconnecting said knife handle to an article of clothing.

16. The folding knife of claim 11, wherein each of said first blade and said second blade comprises an aperture extending through said blade proximate to said heel end and adapted for engagement with a user's thumb, wherein said knife blade can be opened with one hand.

17. The folding knife of claim 11, wherein each of said first blade and said second blade comprises a thumb stud extending through said blade proximate to said heel end and adapted for engagement with a user's thumb, wherein said knife blade can be opened with one hand.

18. The folding knife of claim 11, further comprising a rigid metallic shim plate positioned between said first locking mechanism and said second locking mechanism.

19. A folding knife having adjacent dual blades and associated locking mechanisms, comprising:

a handle having a first end, a second end and a cavity extending substantially therebetween;

a first blade rotatably interconnected to said first end of said handle, said first blade having a pointed end, a heel end, a cutting edge extending substantially therebetween and an engagement slot positioned proximate to said heel end;

a second blade rotatably interconnected to said second end of said handle, said second blade having a pointed end, a heel end, a cutting edge extending substantially therebetween and an engagement slot positioned proximate to said heel end;

a first locking mechanism for said first blade and a second locking mechanism for said second blade, said locking mechanisms positioned substantially adjacent one another within said knife handle, each of said first locking mechanism and said second locking mechanism comprising:

(a) a rigid locking bar having a first end, a second end, an upper edge and a lower edge, said upper edge having a first finger depression and a second finger depression operably sized for receiving a user's thumb, said second finger depression of said first locking mechanism having a greater elevation than said first finger depression of said second locking mechanism and said second finger depression of said second locking mechanism having a greater elevation than said first finger depression of said first locking mechanism;

(b) a biasing means operably interconnected to said handle on a first end and in contact with a lower edge of said rigid locking bar to provide an upward force on said second end of said rigid locking bar proximate said second finger depression, wherein when a downward force is applied to said second finger depression a tang interconnected to said locking bar is released from said engagement slot when said blade is in a first extended position, wherein said knife blade is released to travel from said first extended position of use to a second closed position.

* * * * *